United States Patent [19]

Land

[11] 4,040,210

[45] July 9, 1977

[54] LOW COST STORM WINDOW

[76] Inventor: Edgel T. Land, 1733 S. Urban Way, Lakewood, Colo. 80228

[21] Appl. No.: 691,463

[22] Filed: June 1, 1976

[51] Int. Cl.[2] ..... E06B 7/16

[52] U.S. Cl. ..... 52/2; 49/477; 52/171; 160/90

[58] Field of Search ..... 52/2, 171, 172, 406; 49/477, 62; 160/90

[56] References Cited

U.S. PATENT DOCUMENTS

| | | | |
|---|---|---|---|
| 2,718,014 | 9/1955 | Mizrach et al. | 52/2 X |
| 3,095,947 | 7/1963 | Beaulaurier | 52/2 X |
| 3,911,630 | 10/1975 | Nally | 52/2 |
| 3,918,512 | 11/1975 | Kuneman | 160/90 |

FOREIGN PATENT DOCUMENTS

| | | | |
|---|---|---|---|
| 2,026,260 | 5/1973 | Germany | 52/2 |
| 2,131,873 | 1/1972 | Germany | 52/2 |

*Primary Examiner*—J. Karl Bell

[57] ABSTRACT

The storm window of the invention is adapted to be mounted in a window frame of a house interiorly of the existing window closure. It comprises a hollow structure made up of a plurality of components of thin flexible material, such as plastic sheet, in the form of a panel of substantial thickness with a periphery corresponding to the periphery of the window frame and inner and outer generally planar faces enclosing an insulating dead air space between them. At least part of the structure is inflatable to yieldingly enlarge the periphery and cause the panel to resiliently grip the window frame and retain the panel in position. The major portion of the planform area is substantially transparent to facilitate vision and light transmission through the panel. The structure may be deflated and folded into small compass for storage.

12 Claims, 17 Drawing Figures

LOW COST STORM WINDOW

BACKGROUND OF THE INVENTION

The structure of this invention lies in the field of storm windows and is directed to such windows which are very low in first cost and are very light and easy to install and remove. It is more particularly directed to such windows which may be installed in window frames of a house interiorly of the existing window closures, do not need fasteners fixed to the window frames, and may be stored in minimal space when not in use.

Storm windows are commonly used in all of the colder parts of the country for the purpose of providing a dead air space between the storm window and the existing window closure which serves as insulation to reduce the amount of heat lost to the exterior during winter months. At the present time the cost and the shortage of heating energy supplies has greatly increased the need for such insulation protection.

Conventional storm windows generally consist of wood or metal frames glazed with single panes of glass or relatively thick rigid plastic, the windows being mounted exteriorly of the house on hooks at the upper sides of the window frames, and one or more hooks at the lower end of the window can be fastened to eyes on the window sills from the interior. Release of the lower hooks allows the storm windows to be pivoted outward about the upper fasteners to air out the rooms on occasion. These windows are rigid and heavy and are difficult and sometimes dangerous to install and remove, particularly on windows of the upper floors. Moreover, they are very bulky and require a great deal of storage space when not in use.

In order to improve the insulating effect some storm windows have been double glazed, providing a dead air space between the two panes in addition to the dead air space between the storm window and the normal house window. This is useful but also very expensive because it requires twice as much glass and special frames. Also, such a window is much heavier and consequently more difficult to manipulate.

In the field of mounting techiques it has been proposed to surround the periphery of a storm window pane with a length of tubing which is inflatable to enlarge its periphery and hold it in frictional engagement with a window frame. While this proposal has merit, it calls for a heavy and rather expensive extrusion of rubber or the like which must have a tubular passage, spaced fins to receive the pane, and ribs extending outward to engage a window frame. In addition it requires considerable storage space when not in use.

One proposal for a relatively cheap storm window calls for a sheet of rigid plastic material provided with integral hook-like projections for attaching it to an existing window screen. The fastening means is not too satisfactory, and window screens are usually rather loose fits so that a good deal of air leakage occurs, reducing the insulation value to a marked degree. Also, the unit cannot be collapsed in any way for convenient storage. It does not provide a double pane insulation feature, and if it were built as a double pane unit it would be very costly.

SUMMARY OF THE INVENTION

The construction of the present invention overcomes the difficulties mentioned above and provides a storm window which is light and inexpensive, may be installed interiorly of existing window closures, requires no fasteners fixed to the window frame, and may be collapsed to minimum compass for storage when not in use.

Generally stated, the storm window of the present invention comprises a hollow structure made up of a plurality of components of thin flexible material connected together to form a generally planar panel of substantial thickness presenting inner and outer walls which define and enclose at least one substantially sealed dead air space between them which serves as insulation between the inner and outer walls. The structure has a planform which is sized and shaped to correspond to the size and shape of the window which is to be weather proofed and to fit snugly within the window frame.

At least a portion of the structure is inflatable so that the periphery can be expanded to yieldingly press against opposing areas of the window frame to retain itself in position, and the major portion of the planform area is substantially transparent to facilitate vision and light transmission through the panel. Since the structure is to be mounted in the window frame interiorly of the existing window closure it is not subject to the elements and can be very light and flexible without danger of damage or of being blown out of its mounting. The structure may be fully inflated in advance so that it is slightly oversize and readily pushed into position in the window frame because of the compressibility of the air, or it may be inflated to a lower pressure, placed in position, and then inflated to a higher pressure to produce a very firm grip. At the end of a winter season, the structure is deflated, removed from the window frame, and folded or rolled into a very small package for summer storage.

The structure may be formed in various ways. The simplest and least expensive is a plurality of straight tubes of thin flexible transparent material closed at their ends and bonded together along longitudinal margins of jointure to form a generally planar panel of the proper planform to mount in a window. Each tube may be individually inflatable or all of the tubes may be in flow communication and supplied by one inlet port. The tube may have a round or square cross section. While the irregular generally planar faces of the panel will distort vision as compared to glass it is still possible to see reasonably well through them. Although these and the other forms may be used throughout a house, they are intended primarily for those areas where high light transmission is desired and precise vision is not essential, such as in bedrooms and basements.

The more preferred forms include a framework, which is usually rectangular, of sealed inflatable tubing conformed to fit a particular window frame. Closure means are provided in the form of thin flexible transparent material, preferably plastic, overlying both sides of the framework and connected to it to define and enclose an insulating dead air space. In one form a bag is provided to snugly enclose the framework. In another form individual sheets are provided to overlie the framework and each sheet is bonded to the framework along the periphery. Each panel has a substantial thickness, which corresponds to the diameter of the tubing in the framework, to provide a large dead air space. Since the structure is spaced from the glass panes of the existing window closure, two dead air spaces are provided and the gross insulating value is very high.

The tubing may be inflated initially to a high pressure and the panel forced into place or it may be inflated to a lower pressure, mounted in position, and then inflated to a high pressure for firm retention. When individual sheets are bonded to the framework the dead air space may also be pressurized to rigidify the structure and improve retention.

BRIEF DESCRIPTION OF THE DRAWINGS

Various other advantages and features of novelty will become apparent as the description proceeds in conjunction with the accompanying drawings, in which:

FIG. 9 is a view similar to FIG. 8 showing a different means of securing the framework components;

DESCRIPTION OF PREFERRED EMBODIMENTS

Figure 1:
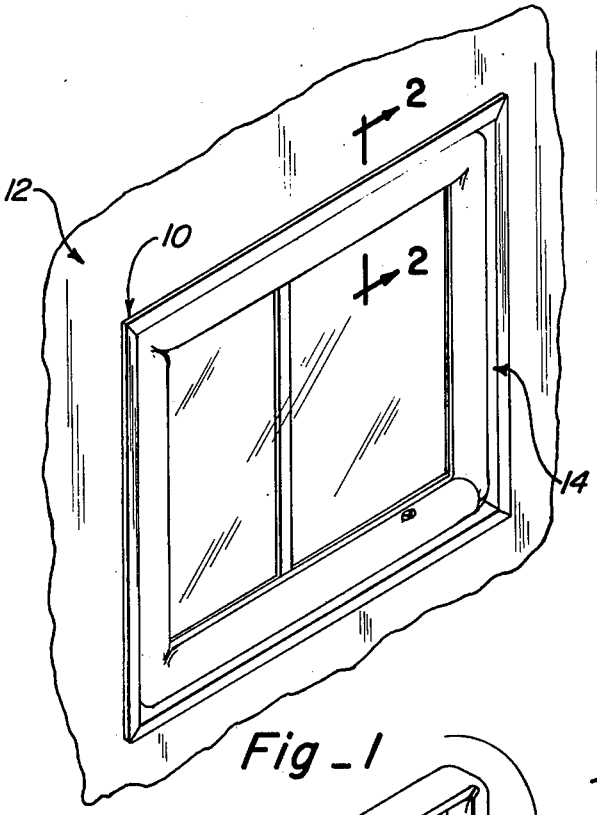
FIG. 1 is a perspective view of an interior wall of a house showing a typical window frame with the structure of the invention mounted therein.

The structure of the invention is schematically illustrated in operative position in FIG. 1, in which the interior portion of a window frame 10 is shown in house wall 12 and a storm window structure 14 is mounted in the window frame. The arrangement is shown in more detail in FIG. 2 including the existing window closure 16, with a conventional glass pane 18. When structure 14 is mounted in operative position it is spaced from pane 18 to form an insulating dead air space 20. The structure is inflated sufficiently to press yieldingly but firmly against the opposing areas of the window frame and frictionally retain itself in position.

Figure 3:
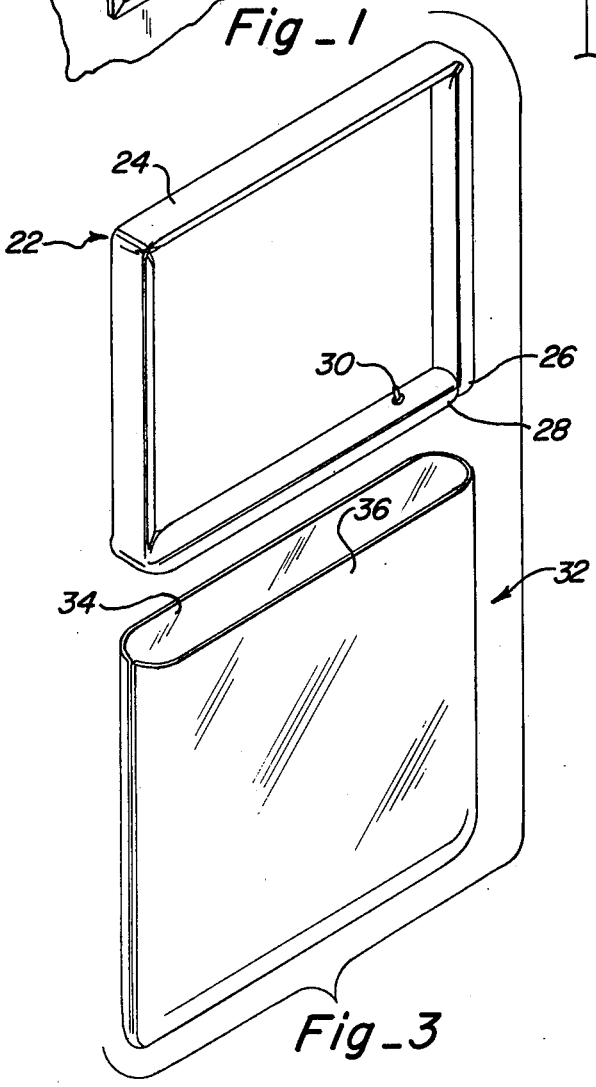
FIG. 3 is an exploded perspective view showing a tubing framework and a bag type closure means.

A first form of the framework 22 is shown in FIG. 3 and comprises a single length of sealed flexible tubing 24 bent to form a rectangle with its sealed ends 26 and 28 abutting, and provided with a valved inflation port 30. The planform of the tubing framework is sized and shaped to correspond to the size and shape of the window frame. Closure means is provided in the form of a bag 32 having inner and outer walls 34 and 36 and dimensioned to snugly receive the inflated framework. Its vertical length as viewed in FIG. 3 is sufficiently greater than the vertical length of the framework to provide excess material for closing the open end of the bag. It may be merely folded on itself to form a substantial seal or bonded to form a total seal.

Figure 2:
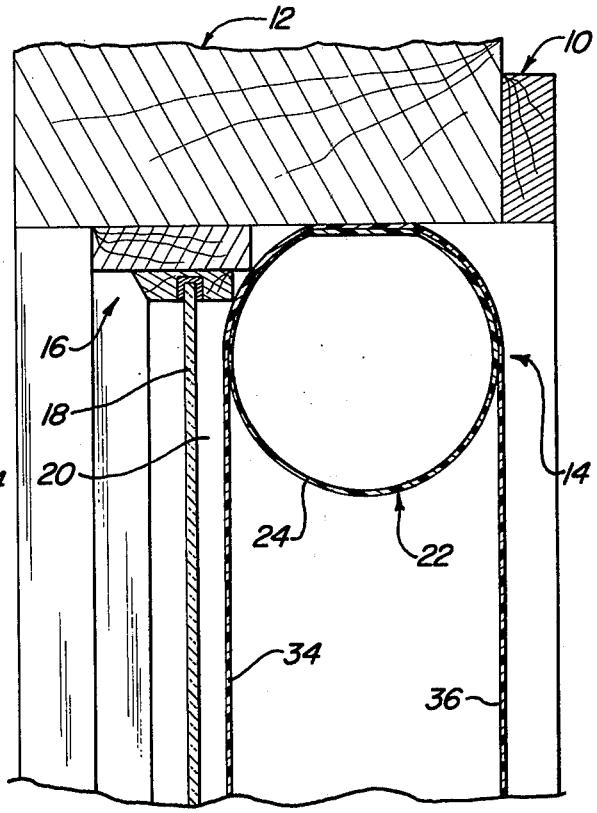
FIG. 2 is a sectional view taken on line 2—2 of FIG. 1.

The tubing component is first inflated to such pressure that it will seat firmly in the window frame and it is then inserted in the bag, and the bag is sealed. The completed structure is then forcefully pressed into the window frame as illustrated in FIG. 2.

Figure 4:
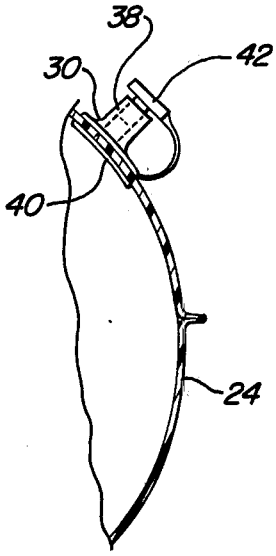
FIG. 4 is a partial view of the tubing in section with an inflation port.

FIG. 4 is a partial sectional view of the tubing component illustrating the typical inflation port 30 which includes a hollow stem 38, a securing head 40 to fasten the port to the tubing, and a plug 42 to close the stem and retain the air in the tubing. The construction is standard and is used with all forms of the structure. Inflation may be by lung power, a hand pump, or any other source of pressurized air.

Figure 5:
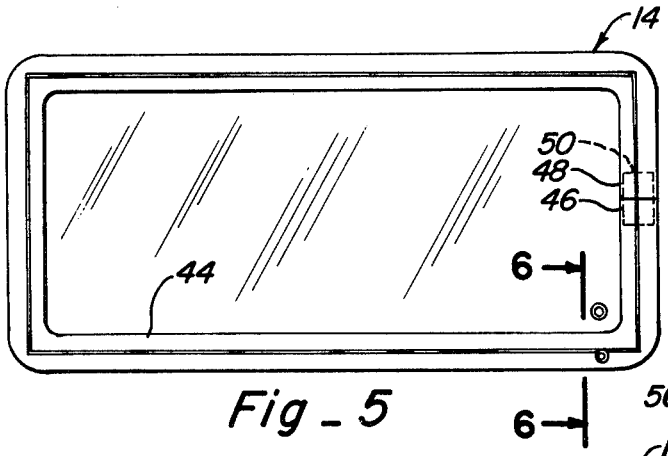
FIG. 5 is a front elevational view of a second form of the structure.
Figure 6:
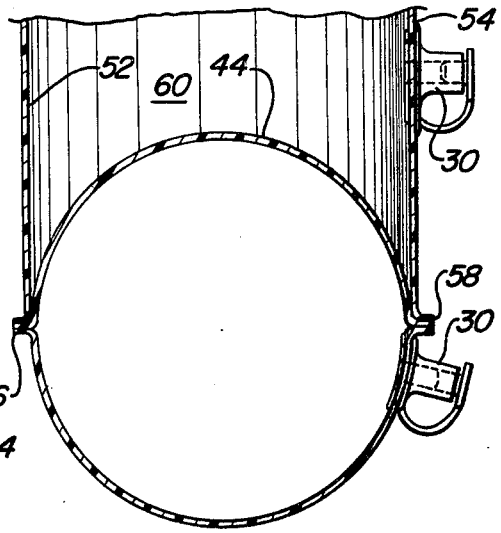
FIG. 6 is a sectional view taken on line 6—6 of FIG. 5.

A variant of the construction is illustrated in FIGS. 5 and 6 in which the tubing component 44 is again a single length of tubing formed into the shape of a rectangle and having its ends 46 and 48 meeting along one of the short sides. The ends may be individually sealed or both slipped over a short length of tubing 50 and sealed to it. The same type of connection may, of course, be used in the form illustrated in FIG. 3. Single sheets of soft flexible transparent material 52 and 54 are cut in the form of rectangles of appropriate size with each sheet being bonded around its periphery to the tubing component 44. The latter may be an extrusion or a single sheet folded over and bonded along a single seam line or two sheets bonded along opposite seam lines 56 and 58 as shown in FIG. 6. This latter form is preferred so that the margins of sheets 52 and 54 may be bonded to the seam lines as shown. The tubing may be of the same thickness as the sheets as indicated in FIG. 6 or substantially thicker to give added firmness, particularly if the rectangle sides are quite long. In addition to the inflation port 30 for the tubing component a similar port may be provided in sheet 54 to inflate the dead air space 60 to a low positive pressure which helps to maintain the panel in position in a window frame.

Figure 7:
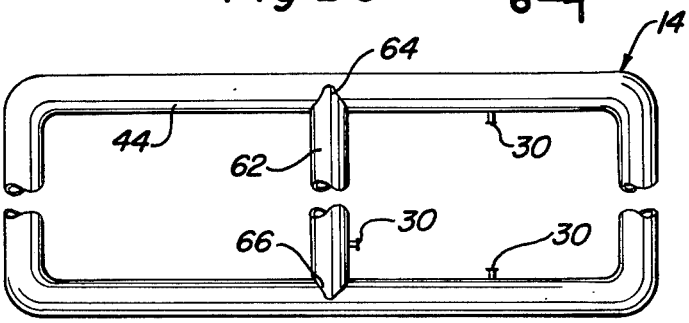
FIG. 7 is an elevational view of a modified form of framework.

When a panel is made up to be mounted in a very long opening such as the doorway of a french door or a high casement window, the inherent flexibility of the tubing component may allow buckling in the intermediate portions of the long sides. To reinforce these portions one or more inflatable mullions 62 are provided and mounted with their ends 64 and 66 pressurally engaging the long sides as shown in FIG. 7. The ends will indent the sides sufficiently to retain them in position but they may be further secured with lengths of adhesive tape if desired.

Figure 8:
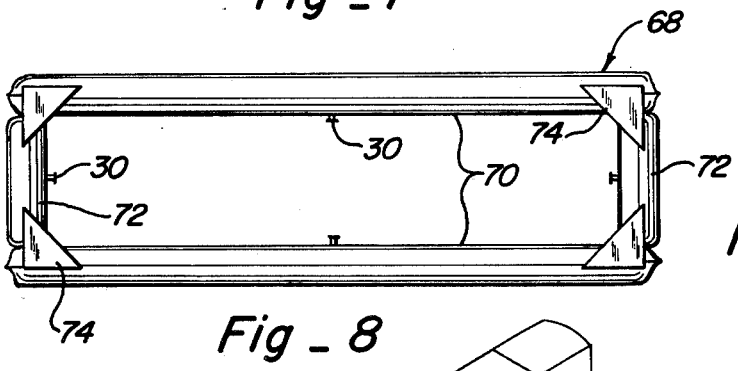
Figure 10:
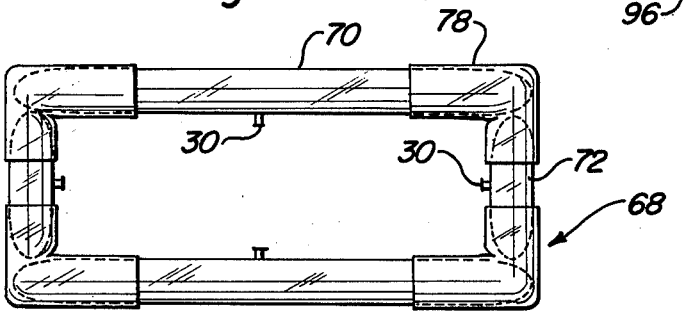
FIG. 10 is a view similar to FIG. 8 showing another means of securing the framework components.
Figure 9:
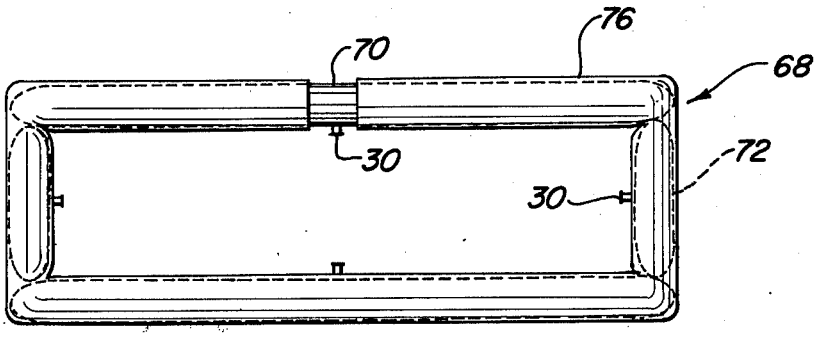
FIG. 9 is an elevational view of a further modified form of framework.

A rectangular or other framework may be made up of a plurality of separate tubing components, each individually sealed and provided with its own inflation port, the adjacent ends of the components being connected by various means as illustrated in FIGS. 8, 9, and 10. In each of these figures, the framework is shown as rectangular and made up of four tubing components although other shapes and numbers of components may be used if desired.

Considering FIG. 8, framework 68 is made up of two components 70 and two components 72, all individually sealed and with their ends in abutting relation. Gussets 74 of the same type of material as the components extend across the junctures at both sides of the framework with each gusset bonded to the two abutting components. The connection is flexible but is sufficient to hold the components in assembled relation for connection to the closure means of FIG. 3 or FIG. 6.

Another securing means is shown in FIG. 9, where an elongate sleeve 76 about equal in length to the combined lengths of all of the tubing components is provided. It may be of the same material as the components or lighter and less costly and is of substantially the same diameter. The tubing components are inserted in the sleeve in end to end relation while slightly inflated to achieve the arrangement shown. Perforations are provided for the passage of ports 30 toward the interior of the framework. The components are then further inflated to achieve the necessary stiffness, after which the closure means is connected to complete the panel.

The construction of FIG. 10 is similar to that of FIG. 9, the elongate sleeve being replaced by a plurality of relatively short sleeves 78, one sleeve being fitted over the abutting ends of each pair of adjacent components.

Figure 11:
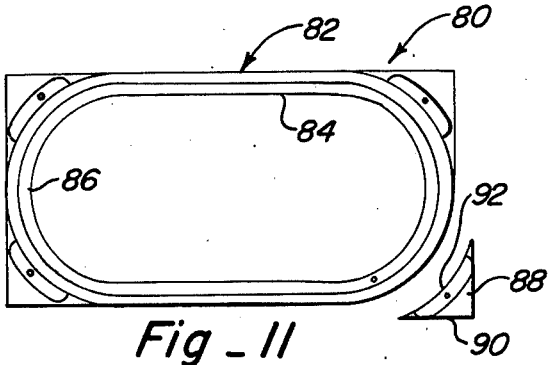
FIG. 11 is an elevational view of a modified form of structure and accessory members.

In some cases when a single tubing component is used it is desirable to provide rounded ends for the framework in order to avoid buckling of the tubing at corners. Such a construction is illustrated in FIG. 11 where the complete panel 80 is formed with a framework 82 having straight sides 84 and rounded ends 86, which is to be mounted in a rectangular window frame. For this purpose, corner filler blocks 88 are provided having square cornered inner sides 90 to fit the window frame and concavely arcuate outer sides 92 to confront the panel. They may be of wood or hollow or foam plastic, or may be inflatable like the panel. When they are mounted in place, they modify the outline of the window frame to correspond to that of the panel.

Figure 14:
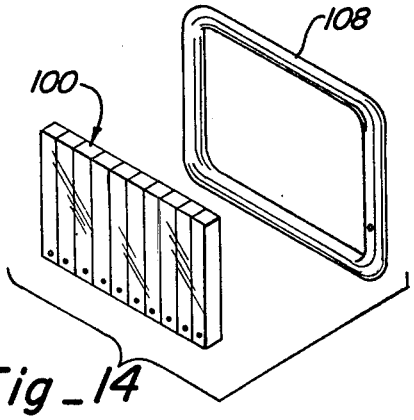
FIG. 14 is a perspective view of the structure of FIG. 13 together with a cooperating framework.
Figure 13:
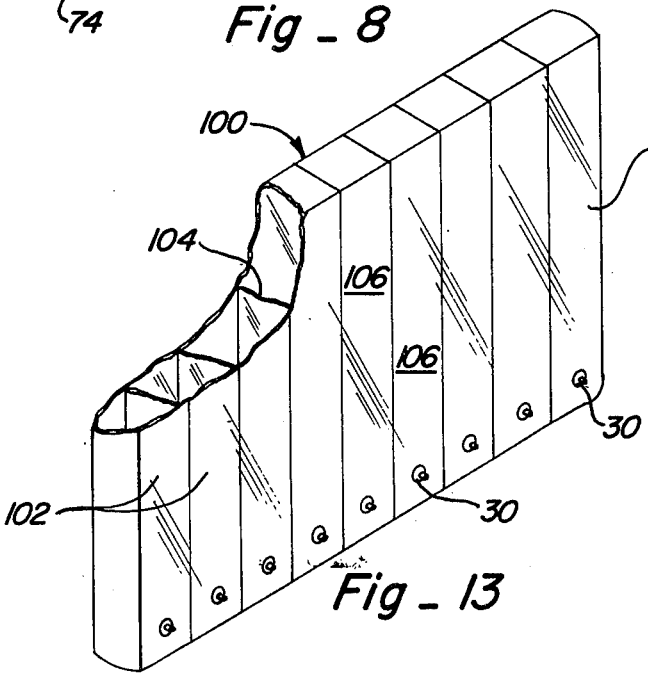
FIG. 13 is a view similar to FIG. 12 showing a variation.
Figure 12:
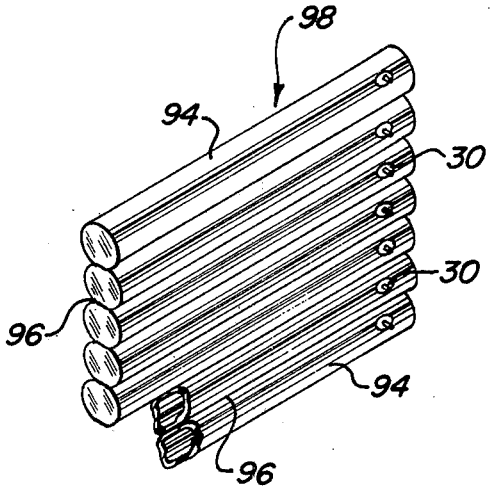
FIG. 12 is a perspective view of a simplified form of the structure.

The simplest construction of a panel of the invention, which would be suitable for a basement window where light is desired but vision is relatively unimportant, is illustrated in FIG. 12. A plurality of straight tubing components 94, closed at their ends and provided with inflation ports 30, are bonded to each other along adjacent side margins 96 to form a panel 98. The construction of FIG. 13 is similar except that panel 100 is made up of tubing components 102 which have generally rectangular cross sections, with side margins 104 bonded together and with outer faces 106 presenting a generally planar surface. The panel may be sized to fit directly into a window frame or to fit into a framework 108 of inflatable tubing as seen in FIG. 14, the framework being sized to fit into the window frame. Panel 98 may likewise be mounted directly or in cooperation with a framework 108.

Figure 15:
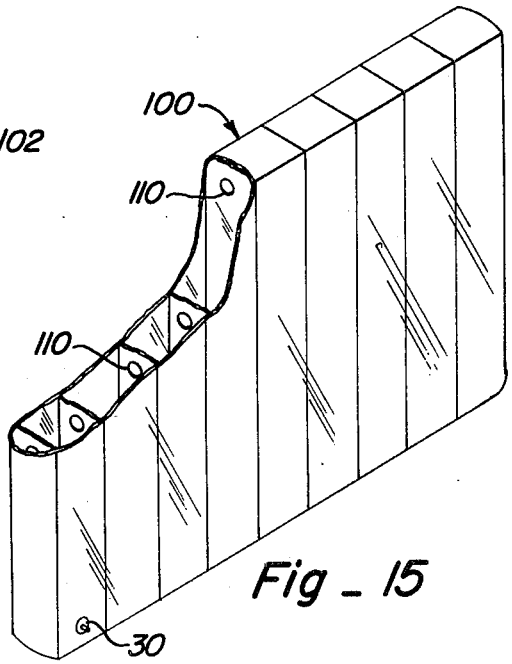
FIG. 15 is a view similar to FIG. 13 showing a modification.

If desired, all of the tubing components of FIG. 12 or FIG. 13 may be in flow communication with each other by means of passages 110 as shown in FIG. 15, in which case one inflation port 30 will serve all of the components.

Figure 16:
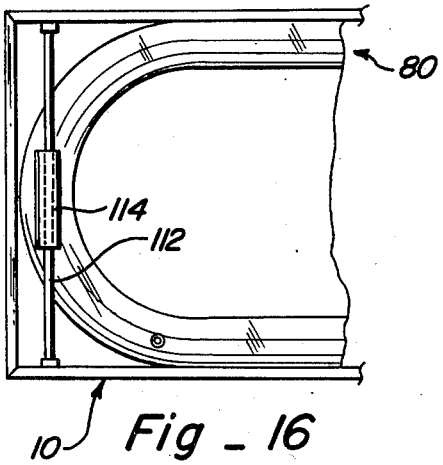
FIG. 16 is a partial elevational view of a structure mounted in a window frame with a retaining rod.

On occasion a window frame will be found which is so shallow between the existing window closure and the outer edge of the frame that the grip of the panel therein is not as secure as desired. In such case the arrangement of FIG. 16 may be used. Panel 80 is mounted in frame 10 and an extensible rod 112 is mounted near each end of the panel overlying a portion of the panel and engaging opposite parallel sides of the window frame to assist in retaining the panel in mounted position. The rod may be spring loaded or threaded to exert enough pressure to secure it in place. A sleeve 114 may be bonded to the panel with the rod passing through the sleeve to prevent disengagement.

Figure 17:
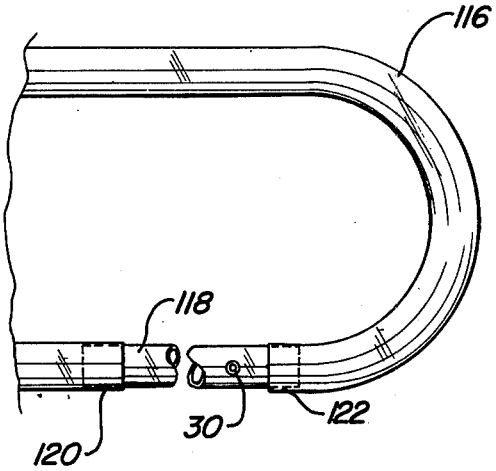
FIG. 17 is a partial elevational view of a framework showing a means for joining the tubing ends.

An example of the manner of connecting the ends of a single tubing component 116 is shown in FIG. 17. A sleeve 118 of similar material but thicker so as to be relatively firmer is inserted into the ends 120 and 122 of the tubing component and is bonded therein to make a complete sealed unit, and the standard inflation port 30 is connected to sleeve 118

From the foregoing, the advantages of this invention are readily apparent. A low cost storm window is provided which does not require rigid material internally but rather since it is inflatable, it has structural integrity of its own. Furthermore, if desired a reflective finish could be placed on one of the planar surfaces for reflecting interior heat inwardly during the winter and it could be reversed in the window for application in the summer for reflecting heat from the sun outwardly so that air conditioning requirements in a building would be reduced.

Another important advantage of this invention is that it can be done on a do-it-yourself basis by the unskilled, the elderly, and other people who live on substantially fixed incomes and who cannot afford to hire labor for installing and removing storm windows on a seasonal basis. Furthermore, they are the ones who would benefit the most by decreased fuel costs.

Furthermore, this invention would find application in not only "colder" climates but milder climates where the cost of conventional storm window is marginal. In other words, because of the low cost, windows constructed in accordance with this invention would be economically feasible in these moderate climate areas.

Finally, because the storm windows are easily removable they can be used in windows that might be utilized as emergency exits in case of fire or disaster.

What is claimed is:

1. A storm window adapted for mounting in the window frame of a house interiorly of the existing window closure, comprising:

a general planar marginal framework of sealed flexible tubing having a planform corresponding in size and shape to the size and shape of the window frame and provided with at least one inflation port to supply air under pressure to its interior to yieldingly enlarge its periphery and cause it to grip opposing areas of the window frame and retain it in predetermined position;

and closure means of thin flexible material extending across the framework at each side thereof and connected to it to form a hollow panel having a thickness substantially corresponding to the diameter of the tubing with substantially planar faces, and cooperating with the framework to define and enclose at least one substantially sealed dead air space to serve as insulation between the inner and outer walls of the panel;

the closure means being substantially transparent to facilitate vision and light transmission through the panel.

2. A window as claimed in claim 1; in which the closure means is in the form of a bag dimensioned to snugly receive the framework and having a length sufficiently greater than the corresponding length of the framework to provide excess material for closing the open end of the bag.

3. A window as claimed in claim 1: in which the closure means is in the form of individual sheets bonded to the tubing at opposite sides of the framework around the periphery to seal the dead air space between the sheets and the framework.

4. A window as claimed in claim 1; in which an inflation port is provided in the closure means to supply air under pressure to the interior of the panel.

5. A window as claimed in claim 1; in which the framework is elongate with straight sides and rounded ends;

and corner filler blocks are provided to be mounted in the corners of a rectangular window frame to cause its periphery to correspond to the planform of the framework.

6. A window as claimed in claim 1; in which a plurality of extensible rods are provided to engage opposite parallel sides of a window frame and overlie portions of the panel to assist in retaining the panel in mounted position.

7. A window as claimed in claim 1; in which the framework is generally rectangular in planform and its length is considerably greater than its width;

and at least one inflatable mullion extends across the width of an intermediate portion of the framework and pressurally contacts the two side marginal elements of the framework to reinforce them against buckling.

8. A window as claimed in claim 1; in which the framework is generally rectangular in planform and comprises a plurality of elongate tubing components constituting the margins of the rectangle;

extraneous securing means is provided to retain them in assembled relation with their confronting ends in adjacency;

and each tubing component is provided with an inflation port.

9. A window as claimed in claim 8; in which the securing means comprises gussets of thin flexible material extending across the ends of adjacent tubing components and bonded to each component.

10. A window as claimed in claim 8; in which the securing means comprises a sleeve of thin flexible material having a length substantially equal to the combined lengths of all of the components and of substantially the same diameter;

and all of the components are inserted within the sleeve in end to end relation.

11. A window as claimed in claim 8; in which the securing means comprises a plurality of short sleeves of thin flexible material of substantially the same diameter as the tubing components;

and each pair of adjacent component ends are inserted within one of the sleeves substantially in contact with one another.

12. An interior storm window construction comprising:

a generally rectangular window frame in a house wall extending between the inner and outer margins of the wall;

a window closure extending across the window frame in a general plane located between the inner and outer margins;

and a hollow structure including a plurality of components of thin flexible material connected together to form a generally planar panel of substantial thickness presenting inner and outer walls which define and enclose a substantially sealed dead air space between them to serve as insulation between the inner and outer panel walls;

the structure including a marginal framework of substantially transparent sealed thin flexible tubing corresponding in size and shape to the size and shape of the window frame interiorly of the window closure and a layer of substantially transparent thin flexible material overlying the framework at each side to define the composite hollow panel;

the tubing being provided with an inflation port to supply air under pressure to its interior to yieldingly enlarge the periphery of the framework and cause it to frictionally grip opposing areas of the window frame and retain the structure in predetermined position;

the panel being mounted in the window frame in such position that its outer confronting face is spaced from at least the major portion of the area of the window closure by a substantial distance to produce a second dead air insulating space between them.

* * * * *